US009854367B2

(12) United States Patent
Park

(10) Patent No.: US 9,854,367 B2
(45) Date of Patent: Dec. 26, 2017

(54) HIGH SENSITIVITY MICROPHONE

(71) Applicant: Hyundai Motor Company, Seoul (KR)

(72) Inventor: Sang Gyu Park, Seoul (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 15/270,228

(22) Filed: Sep. 20, 2016

(65) Prior Publication Data

US 2017/0332177 A1 Nov. 16, 2017

(30) Foreign Application Priority Data

May 11, 2016 (KR) ..... 10-2016-0057792

(51) Int. Cl.
*H04R 3/00* (2006.01)
*H04R 19/04* (2006.01)
*H04R 29/00* (2006.01)

(52) U.S. Cl.
CPC ..... *H04R 19/04* (2013.01); *H04R 3/007* (2013.01); *H04R 29/004* (2013.01); *H04R 2201/003* (2013.01)

(58) Field of Classification Search
CPC ..... H04R 3/00
See application file for complete search history.

(56) References Cited

U.S. PATENT DOCUMENTS 6,459,331 B1 * 10/2002 Takeuchi ..... H03K 19/00361 327/311
2007/0263847 A1 * 11/2007 Konchitsky ..... G10L 21/0208 379/392.01
2009/0232335 A1 * 9/2009 Kondo ..... H04R 1/04 381/174
2014/0307910 A1 * 10/2014 Howlett ..... H04R 3/00 381/369
2016/0037266 A1 * 2/2016 Uchida ..... H04R 7/06 381/71.8
2016/0100250 A1 * 4/2016 Baskin ..... B60N 2/4876 297/217.4

(Continued)

FOREIGN PATENT DOCUMENTS

JP 2006-229336 A 8/2006
JP 2009-239832 A 10/2009

(Continued)

*Primary Examiner* — Olisa Anwah
(74) *Attorney, Agent, or Firm* — Morgan, Lewis & Bockius LLP

(57) ABSTRACT

A high sensitivity microphone may include a sound detecting module including a vibration film and a fixed film, a power source circuit supplying a power source to the sound detecting module through a switch control of a first switch applying a first bias and a second switch applying a second bias, a detecting circuit removing a noise included in a first capacitance signal and a second capacitance signal that are differential input from the sound detecting module, according to a switch control of a third switch inputting the first capacitance signal in conjunction with the first switch and a fourth switch inputting the second capacitance signal in conjunction with the second switch, and a switch controller performing a first switch mode linking the first switch and the third switch and a second switch mode linking the second switch and the fourth switch for differential input and output of the microphone.

13 Claims, 10 Drawing Sheets

(56) References Cited

U.S. PATENT DOCUMENTS

| | | | | |
|---|---|---|---|---|
| 2017/0160337 | A1* | 6/2017 | Steele | G01R 31/2829 |
| 2017/0187423 | A1* | 6/2017 | Rouaissia | H04B 5/0012 |
| 2017/0227569 | A1* | 8/2017 | Alwardi | G01P 15/0802 |

FOREIGN PATENT DOCUMENTS

| | | | |
|---|---|---|---|
| KR | 10-2014-0036790 | A | 3/2014 |
| KR | 10-1379680 | B1 | 3/2014 |
| KR | 10-1601179 | B1 | 3/2016 |
| KR | 10-1601229 | B1 | 3/2016 |
| KR | 10-2016-0045024 | A | 4/2016 |

* cited by examiner

HIGH SENSITIVITY MICROPHONE

CROSS-REFERENCE TO RELATED APPLICATION

The present application claims priority to Korean Patent Application No. 10-2016-0057792, May 11, 2016, the entire contents of which is incorporated herein for all purposes by this reference.

BACKGROUND OF THE INVENTION

Field of the Invention

The present invention relates to a high sensitivity microphone. More particularly, the present invention relates to a high sensitivity microphone improved with a noise characteristic used on an electronic device in a vehicle.

Description of Related Art

In general, a microphone means a device converting a sound such as circumjacent sounds or voices into an electrical signal to be processed as a signal that may be finally recognized by a person or a machine.

The microphone is used to a hands-free and a voice recognition, etc. of the electronic device in the vehicle as well as a mobile device and a sound device and is input with the signal of wide frequency range on a characteristic such that a noise characteristic is very important to increase a recognition success.

The microphone is input with the natural signal such as a sound wave such that an analog signal processing is necessary in the signal conversion. Accordingly, a performance of a circuit for the analog signal processing directly affects the entire performance of the microphone.

The conventional microphone includes a micro electro mechanical system (MEMS) in which one vibration film and one fixed film are configured to be separated.

In the conventional microphone, if the vibration film receives a pressure by a sound pressure, the interval with the fixed film is changed, accordingly a capacitance change occurs, and the change amount of the capacitance is converted into an output voltage through a buffer.

Since the conventional microphone has a single input signal, a power supply noise and the noise contained in a bias voltage are output through the buffer just as it was such that there is a drawback that the sensitivity is deteriorated. This causes the inadequate performance in high sensitivity microphone such that a problem that the performance and the quality of the applied electronic device are deteriorated is existed.

On the other hand, to solve this problem, a microphone technique improving a signal to noise ratio (SNR) by receiving the sound pressure through two MEMS has been developed.

Accordingly, when the sound pressure is input by disposing two MEMS ($MEMS_1$ and $MEMS_2$), the power source noise ($V_N$) is removed in a condition that sensitivity constants and the capacitances of the $MEMS_1$ and $MEMS_2$ are the same and the signal of which the sensitivity depending on the sound pressure is two times is output as merits.

However, there are drawbacks that a cost increases by using two MEMS and a process error is inevitable between two MEMS.

Particularly, when the process error (e.g., differences of the sensitivity constants or the capacitances) is generated between the $MEMS_1$ and the $MEMS_2$, the noise is not completely removed.

Accordingly, the performance deterioration causes the performance deterioration of the voice recognition and the hands-free when being applied to the electronic device in the microphone, thereby leading to customer dissatisfaction.

Accordingly, the development of high sensitivity microphone increasing the recognition success by solving the conventional noise problem and the process error problem is required.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a high sensitivity microphone solving a noise problem due to a process error of the microphone using a plurality of conventional MEMS and increasing an output signal through the signal processing of a single sound detecting module of dual fixed film, shape.

According to various aspects of the present invention, a high sensitivity microphone may include a sound detecting module including a vibration film and a fixed film separated from the vibration film, a power source circuit supplying a power source, supplied from an outside, to the sound detecting module through a switch control of a first switch applying a first bias and a second switch applying a second bias that is opposed to the first bias, a detecting circuit removing a noise included in a first capacitance signal and a second capacitance signal that are differential input from the sound detecting module, according to a switch control of a third switch inputting the first capacitance signal in conjunction with the first switch and a fourth switch inputting the second capacitance signal in conjunction with the second switch, and a switch controller performing a first switch mode linking the first switch and the third switch and a second switch mode linking the second switch and the fourth switch for a differential input and output of the microphone.

The power source circuit may turn on the first switch according to the first switch mode control and turn off the second switch to apply the first bias to the sound detecting module, and may turn off the first switch according to the second switch mode control and turn on the second switch to apply the second bias to the sound detecting module.

The detecting circuit may include a sample and hold circuit maintaining a voltage change amount depending on a sound pressure change amount transmitted from the sound detecting module, and a calculating amplifier removing a noise and amplifying the first capacitance signal and second capacitance signal to be output as a final output voltage when the first capacitance signal and the second capacitance signal depending on the voltage change amount are input.

The sample and hold circuit may maintain a voltage of the corresponding capacitance signal by memorizing the input voltage change amount even when one of the third switch and the fourth switch of the detecting circuit is turned off by a switching of the switch mode.

The calculating amplifier may remove the noise of the first capacitance signal and the second capacitance signal respectively input to a plurality of input terminals and output a final output signal of which each capacitance signal removed with the noise may be amplified to the output terminal.

The detecting circuit may determine a final output as a value that the second capacitance signal is subtracted from the first capacitance signal.

The first capacitance signal in the first switch mode and the second capacitance signal in the second switch mode may be generated with a same sensitivity and capacitance change amount detecting condition.

According to various aspects of the present invention, a high sensitivity microphone may include a sound detecting module including dual vibration films and a fixed film between the dual vibration films, a power source circuit supplying a power source supplied from an outside to the sound detecting module through a switch control of a first switch applying a first bias and a second switch applying a second bias that is opposed to the first bias, a detecting circuit removing a noise included in a first capacitance signal and a second capacitance signal that are differential input from the sound detecting module, according to a switch control of a third switch inputting the first capacitance signal in conjunction with the first switch and a fourth switch inputting the second capacitance signal in conjunction with the second switch, and a switch controller performing a first switch mode linking the first switch and the third switch, and a second switch mode linking the second switch and the fourth switch for a differential input and output of the microphone.

The detecting circuit may output the first capacitance signal varied based on the voltage respectively output from the dual fixed film according to a sound pressure change amount of the sound detecting module when the first bias is applied to the sound detecting module by the turning on of the first switch of the power source circuit.

The detecting circuit may output the second capacitance signal varied based on the voltage respectively output from the dual fixed films according to the sound pressure change amount of the sound detecting module when the second bias opposed to the first bias is applied to the sound detecting module by the turning on of the second switch of the power source circuit.

The detecting circuit may include a third switch inputting the first capacitance signal to the calculating amplifier in conjunction with the first switch of the power source circuit during the first switch mode, and a fourth switch inputting the second capacitance signal to the calculation amplifier in conjunction with the second switch of the power source circuit during the second switch mode.

The detecting circuit may include a sample and hold circuit memorizing the voltage change amount transmitted from the sound detecting module and maintaining a voltage of the corresponding capacitance signal even when one of the third switch and the fourth switch of the detecting circuit is turned off by a switching of the switch mode.

The detecting circuit may include a calculating amplifier removing the noise included in the first capacitance signal and the second capacitance signal input to a plurality of input terminals from the sample and hold circuit and outputting a final output signal that each capacitance signal removed with the noise may be amplified to the output terminal.

According to various embodiments of the present invention, the output signal by the sound pressure increases by at least twice through the dual fixed film MEMS structure and the signal processing structure removing the noise generated in the back bias such that the high sensitivity microphone improving the signal-to-noise ratio may be provided.

Also, by applying the sound detecting module of the single MEMS structure to the high sensitivity microphone, the process error in the conventional microphone applied with the plurality of MEMS may be solved.

Also, by applying the high sensitivity microphone of which the noise is removed and the sensitivity is improved to the vehicle, the sound recognition and the hands free performance in the vehicle may be improved such that an effect improving the customer satisfaction may be expected.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, in various embodiments of the present invention, the high sensitivity microphone that is strong to the process error is proposed to remove the noise generated in a back bias and simultaneously to solve the noise problem due to the process error of the microphone using the plurality of conventional micro electro mechanical systems (MEMS).

The high sensitivity microphone according to various embodiments of the present invention has a switching structure to realize the same function as processing the signal through almost two MEMS by using one of the MEMS, and a description thereof will be described with respect to the following exemplary embodiments.

Figure 1:
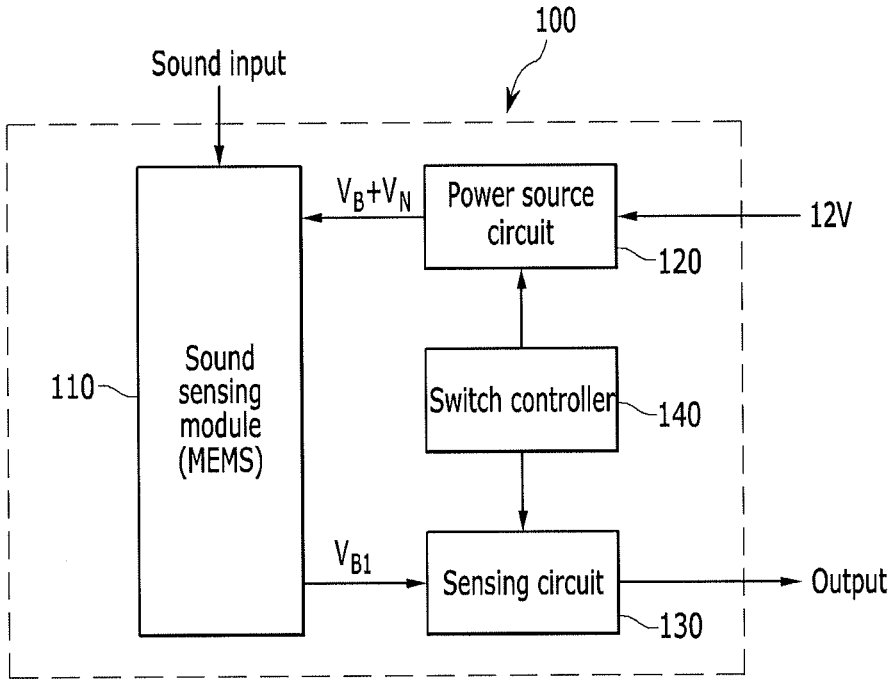
FIG. 1 is a block diagram schematically showing a configuration of a high sensitivity microphone according to various embodiments of the present invention.

FIG. 1 is a block diagram schematically showing a configuration of a high sensitivity microphone according to a first exemplary embodiment of the present invention.

Figure 2:
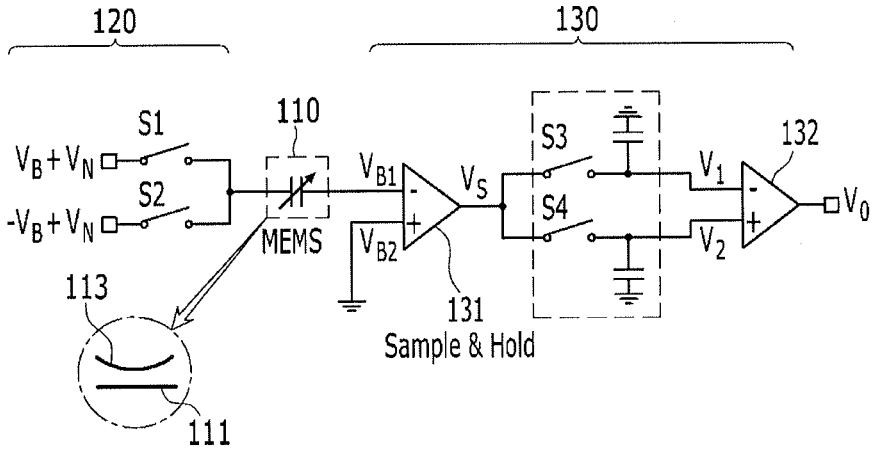
FIG. 2 is a view showing a signal processing structure of a high sensitivity microphone according to various embodiments of the present invention.

FIG. 2 is a view showing a signal processing structure of a high sensitivity microphone according to the first exemplary embodiment of the present invention.

Referring to FIG. 1 and FIG. 2, the microphone 100 according to the first exemplary embodiment of the present invention includes a sound detecting module 110, a power source circuit 120, a detecting circuit 130, and a switch controller 140.

The sound detecting module 110 is formed of single MEMS and vibrates by the sound pressure depending on the sound signal input from an output to generate an electronic signal.

The sound detecting module 110 includes a vibration film 113 vibrated by the sound pressure inflowing from the outside and a fixed film 111 that is separate from the vibration film 113 via an air layer and is not vibrated.

If the vibration film 113 receives the pressure by the sound pressure, the physical change is generated to the interval with the fixed film 111 and the sound detecting module 110 outputs the capacitance signal by the voltage change amount.

The power source circuit 120 includes a plurality of switches S1 and S2 and supplies a power supplied from the outside through the switch control to the sound detecting module 110.

The power source circuit 120 receives the power (12V) from the power source being a battery of a vehicle to apply a back bias voltage to the sound detecting module 110 through a periodic switching of the first switch S1 and the second switch S2.

For example, power source circuit 120 turns on the first switch S1 to apply a first bias $V_B$ to the sound detecting module 110, and turns on the second switch S2 to apply a second bias $-V_B$ that is contradictory to the first bias $V_B$ to the sound detecting module 110.

The detecting circuit 130 includes a plurality of switches, the noise is removed and the amplified output signal of the first capacitance signal and the second capacitance signal are output based on the first capacitance $V_1$ signal and the second capacitance signal $V_2$ that are differential input from the sound detecting module 110 by the switch control.

For this, the detecting circuit 130 includes a sample and hold circuit 131 detecting a voltage change amount Vs depending on the sound pressure change amount from the sound detecting module 110 and a calculating amplifier 132 removing the noise and amplifying the capacitance signal $V_1$ and $V_2$ to be output as a final output voltage if the capacitance signals $V_1$ and $V_2$ depending on the voltage change amount Vs are input.

Also, the detecting circuit 130 includes a third switch S3 and a fourth switch S4 provided between the sample and hold circuit 131 and the calculating amplifier 132.

The third switch S3 may input the first capacitance signal $V_1$ to the calculating amplifier 132 in conjunction with the first switch S1 of the power source circuit 120, and the fourth switch S4 may input the second capacitance signal $V_2$ to the calculation amplifier in conjunction with the second switch.

The switch controller 140 controls the switches S1-S4 by two switch modes for the differential input and output of the microphone 100.

The switch controller 140 may perform the first switch mode that turns on the first switch S1 and the third switch S3 and turns off the second switch S2 and the fourth switch S4.

Also, the switch controller 140 may perform the second switch mode that turns off the first switch S1 and the third switch S3 and turns on the second switch S2 and the fourth switch S4.

Accordingly, an input terminal of the calculating amplifier 132 is connected to the sound detecting module 100 through the third switch S3 during the first switch mode such that the first capacitance signal $V_1$ including the noise may be input.

Also, an inverted terminal of the calculating amplifier 132 is connected to the sound detecting module 100 through the fourth switch S4 during the second switch mode such that the second capacitance signal including the noise may be input.

Next, the signal processing method of the switch control of the microphone according to the first exemplary embodiment of the present invention will be described in further detail with reference to FIG. 3 and FIG. 4.

Figure 3:
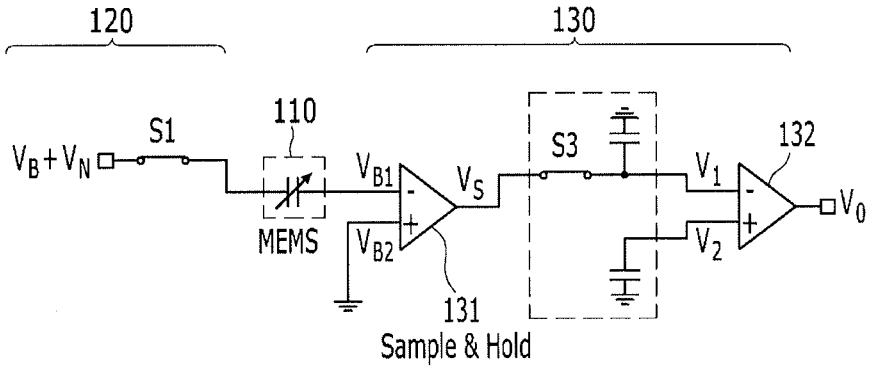
FIG. 3 is a view showing a signal processing structure in a first switch mode according to various embodiments of the present invention.

FIG. 3 is a view showing a signal processing structure in the first switch mode according to the first exemplary embodiment of the present invention.

Referring to FIG. 3, in the microphone signal processing structure of FIG. 2, the signal processing structure of the state in which the first switch S1 and the third switch S3 are turned on and the second switch S2 and the fourth switch S4 are turned off is shown.

The power source circuit 120 turns on the first switch to apply the first bias $V_B$ to the sound detecting module 110, and the first capacitance signal $V_1$ that is varied depending on the sound pressure change amount is output in the sound detecting module 110.

The first capacitance signal $V_1$ may be determined by at least one among the sensitivity of the sound detecting module 100, the capacitance, the sound pressure, the noise, and the bias.

In this case, the detecting circuit 130 may calculate the voltage change amount Vs depending on the sound pressure change amount and the first capacitance signal $V_1$ through [Equation 1] below.

$$V_S=-\kappa C_0(V_B+V_N)\Delta P_S$$

$$\therefore V_1=-\kappa C_0(V_B+V_N)\Delta P_S \quad \text{(Equation 1)}$$

Here, $V_S$ represents the voltage change amount depending on the sound pressure change amount, k represents a sensitivity constant, $C_0$ represents an initial capacitance, $V_B$ represents the bias, $\Delta P_S$ represents the sound pressure, $V_N$ represents the noise, and $V_1$ represents the first capacitance signal.

In this case, the sample and hold circuit 131 of the detecting circuit 130 memories the input voltage change amount $V_S$ to perform a function maintaining the voltage of the first capacitance signal even if the third switch S3 connected to the input terminal of the calculating amplifier 132 input with the first capacitance signal $V_1$ is turned off by the second switch mode.

Figure 4:
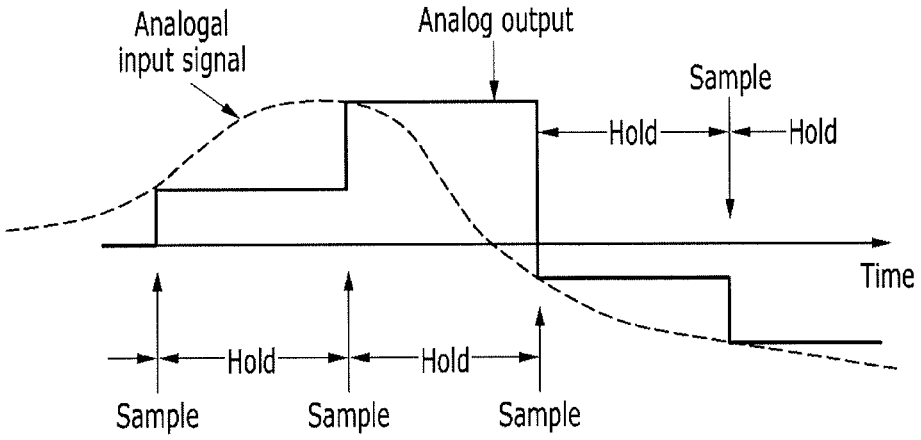
FIG. 4 is a view showing an operation principle of a sample and hold circuit according to various embodiments of the present invention.

Meanwhile, FIG. 4 is a view showing an operation principle of a sample and hold circuit according to various embodiments of the present invention.

Referring to FIG. 4, if an analog input signal of a continuous waveform (a continuous signal) is input, the sample and hold circuit 131 serves receiving and sampling a clock signal from a periodic switch control signal and maintaining a voltage thereof with a discrete waveform (a discrete signal).

In the present invention, the first capacitance signal $V_1$ and the second capacitance signal $V_2$ are operated on different time zones according to two switch modes, and two signals must be maintained to calculate ($V_1$-$V_2$) the final output signal $V_0$ from which the noise is removed in the calculating amplifier 132.

Accordingly, even if one of the third switch S3 and the fourth switch S4 is turned off by the switching of the switch mode, the sample and hold circuit 131 serves to maintain the corresponding voltage of the capacitance signal.

Figure 5:
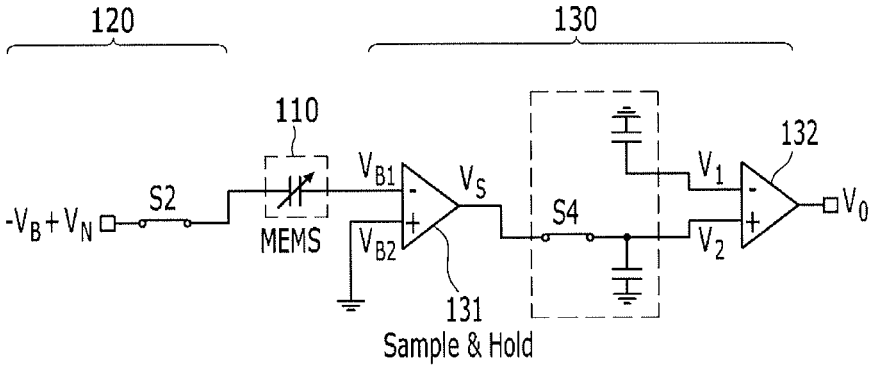
FIG. 5 is a view showing a signal processing structure in a second switch mode according to various embodiments of the present invention.

FIG. 5 is a view showing a signal processing structure in a second switch mode according to the first exemplary embodiment of the present invention.

Referring to FIG. 5, by the same method as that of FIG. 3, in the microphone signal processing structure of the FIG. 2, the signal processing structure of the case that the second switch S2 and the fourth switch S4 are turned on and the first switch S1 and the third switch S3 are turned off is shown.

The power source circuit 120 turns on the second switch S2 to apply the second bias $-V_B$ that is contradictory to the first bias $V_B$ to the sound detecting module 110 and the capacitance signal varied depending on the sound pressure change amount is output in the sound detecting module 110.

In this case, the detecting circuit 130 may calculate the voltage change amount Vs depending on the sound pressure change amount and the second capacitance signal $V_2$ according thereto through [Equation 2] below.

$$V_S=-\kappa C_0(-V_B+V_N)\Delta P_S$$

$$\therefore V_2=-\kappa C_0(-V_B+V_N)\Delta P_S \quad \text{(Equation 2)}$$

Here, $V_S$ represents the voltage change amount, k represents the sensitivity constant, $C_0$ represents the initial capacitance, $V_B$ represents the bias, $\Delta P_S$ represents the sound pressure, $V_N$ represents the noise, and $V_2$ represents the second capacitance signal.

In this case, the noise may be included in the first capacitance signal $V_1$ and the second capacitance signal $V_2$ as confirmed in [Equation 1] and [Equation 2].

On the other hand, the calculating amplifier 132 removes the noise from the first capacitance signal $V_1$ and the second capacitance signal $V_2$ that are respectively input from the plurality of input terminals and outputs the final output signal $V_O$ that each capacitance signal without the noise is amplified to the output terminal.

The output signal $V_O$ is a value that the second capacitance signal $V_2$ is subtracted from the first capacitance signal $V_1$ and may be determined by [Equation 3].

$$V_0=V_1-V_2=-\kappa C_0(V_B+V_N)\Delta P_S+\kappa C_0(-V_B+V_N)\Delta P_S$$

$$\therefore V_0=-2\kappa C_0 V_B\Delta P_S \quad \text{(Equation 3)}$$

Here, $V_0$ represents the output signal, $V_1$ represents the first capacitance signal, $\Delta V_2$ represents the second capacitance signal, k represents the initial sensitivity constant, $C_0$ represents the initial capacitance, $V_B$ represents the bias, and $\Delta P_S$ represents the sound pressure.

In this case, in the first exemplary embodiment of the present invention, the single sound detecting module 100 such that the output signal $V_O$ of which the noise $V_N$ is removed regardless of the process error like Equation 3, and the sensitivity depending on the sound pressure is two times may be output.

Figure 6:
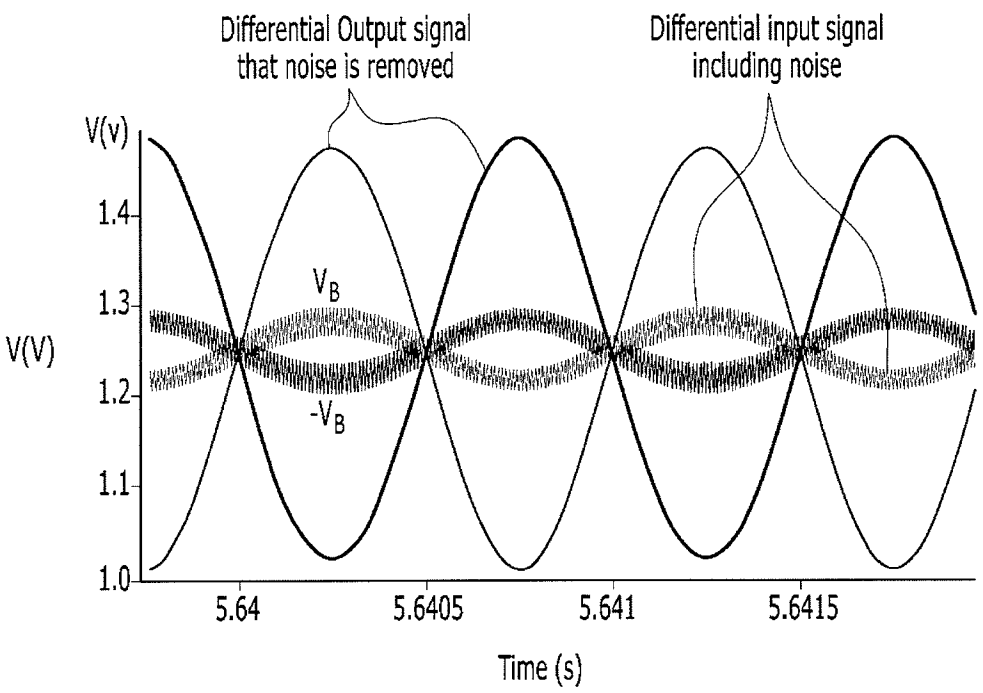
FIG. 6 is a graph showing a simulation result using a microphone according to various embodiments of the present invention.

FIG. 6 is a graph showing a simulation result using a microphone according to the first exemplary embodiment of the present invention.

Referring to FIG. 6, it may be confirmed that the first capacitance signal $V_B$ and the second capacitance signal $-V_B$ including the noise are input according to the bias differential input, and the differential output signal that the noise is removed from the first capacitance signal $V_B$ and the second capacitance signal $-V_B$ and is amplified is output.

Second Exemplary Embodiment

The second exemplary embodiment of the present invention is similar to the above-described first exemplary embodiment of microphone 100, however it is different that the sound detecting module 110' is formed a dual fixed film MEMS removing the noise generated from the back bias.

Accordingly, since the second exemplary embodiment is similar to the first exemplary embodiment, the overlapping descriptions are omitted and differences will be mainly described.

Figure 7:
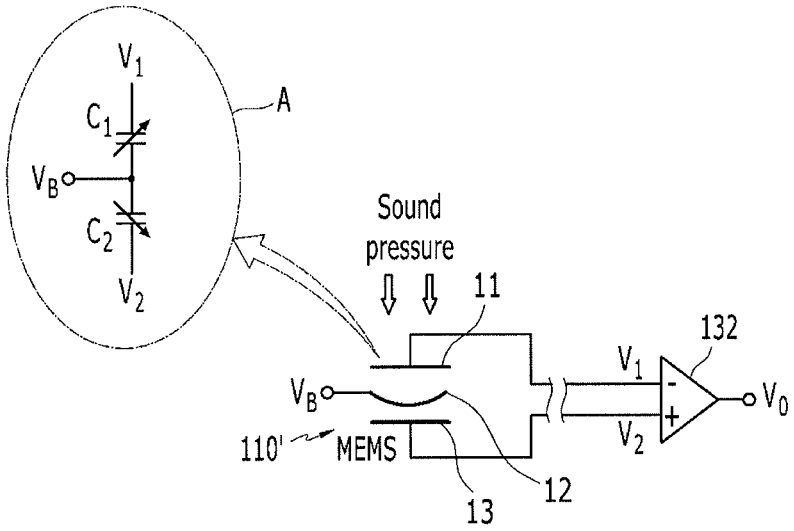
FIG. 7 is a view schematically showing a structure of a dual fixed film sound detecting module (MEMS) according to various embodiments of the present invention.

FIG. 7 is a view schematically showing a structure of a dual fixed film sound detecting module (MEMS) according to the second exemplary embodiment of the present invention.

Referring to FIG. 7, the sound detecting module 110' in the second exemplary embodiments of the present invention is formed of the single MEMS including dual fixed films 11 and 13 of a sandwich shape and one vibration film 12 installed between the dual fixed films to be separated therefrom.

In the sound detecting module 100', if the sound pressure is applied, while the interval of the vibration film 12 with the upper fixed film 11 is increased, the interval with the lower fixed film 13 is decreased, and each fixed film generates the capacitance depending on the interval change with the vibration film.

When expressing this sound detecting module 100' conceptually, as shown in 'A' of FIG. 7, the sound detecting module 100' may be represented by dual-conFIG. variable condensers $C_1$ and $C_2$. In this case, it may be expressed that the upper fixed film 11 corresponds to the first variable condensers $C_1$ and the lower fixed film corresponds to the second variable condensers $C_2$.

Figure 8:
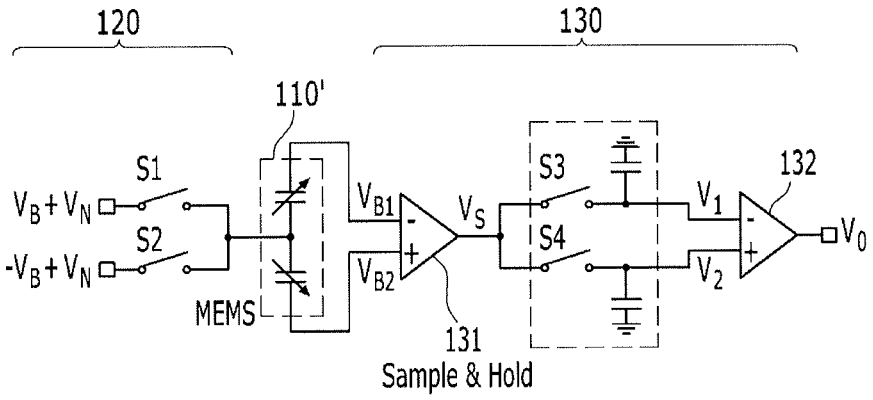
FIG. 8 is a view showing a signal processing structure of a high sensitivity microphone according to various embodiments of the present invention.

FIG. 8 is a view showing a signal processing structure of a high sensitivity microphone according to a second exemplary embodiment of the present invention.

Referring to FIG. 8, the second exemplary embodiment of the present invention as the signal processing circuit structure applied with the sandwich dual fixed film sound detecting module 110' may be implemented so that the power noise is removed and the sensitivity depending on the sound pressure is quadruples.

Figure 9:
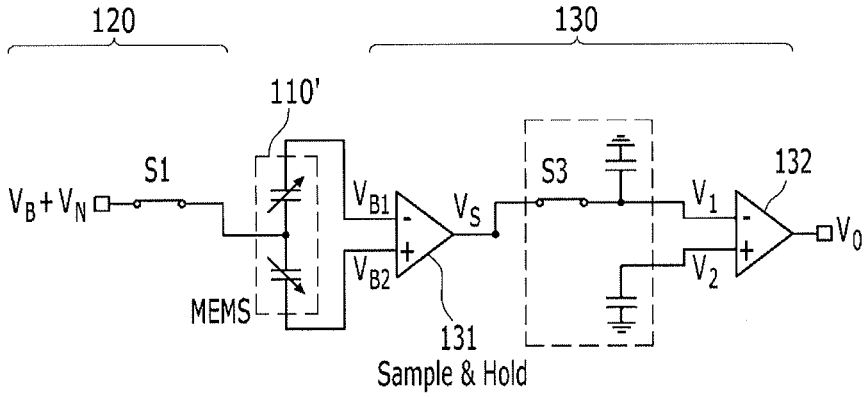
FIG. 9 is a view showing a signal processing structure in a first switch mode according to various embodiments of the present invention.
Figure 10:
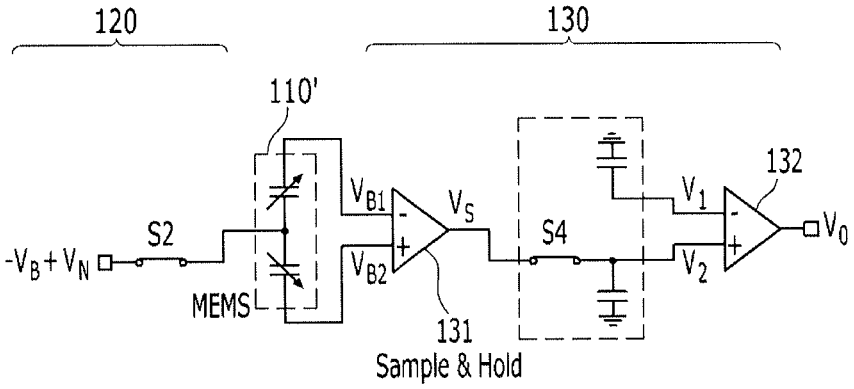
FIG. 10 is a view showing a signal processing structure in a second switch mode according to various embodiments of the present invention.

This is switched by the first switch mode and the second switch mode with the same method as the above-described first exemplary embodiment and may obtain the signal processing result like FIG. 9 and FIG. 10 following.

In following description, since the sound detecting module 110' is configured of the single MEMS, it is clear that the sensitivity constant ($k_1$=$k_2$) and the capacitance ($C_1$=$C_2$) change amount detecting condition in the first switch mode and the second switch mode is the same such that the problems due to the conventional process error may be solved.

FIG. 9 is a view showing a signal processing structure in a first switch mode according to a second exemplary embodiment of the present invention.

Referring to FIG. 9, the switch controller 140 controls the switches with the first switch mode such that the signal processing structure in which the first switch S1 and the third switch S3 are turned on, and the second switch S2 and the fourth switch S4 are turned off is shown.

The power source circuit 120 turns on the first switch S1 to apply the first bias $V_B$ to the sound detecting module 110.

The detecting circuit 130 outputs the varied first capacitance signal $V_1$ based the voltages $V_{B1}$ and $V_{B2}$ respectively output from the dual fixed film depending on the sound pressure change amount input to the sound detecting module 110'.

In this case, the voltages $V_{B1}$ and $V_{B2}$ and the first capacitance signal $V_1$ respectively output from the dual fixed film may be calculated through [Equation 4] following.

$$V_{B1}=-\kappa_1 C_1(V_B+V_N)\Delta P_S, V_{B2}=-\kappa_2 C_2(V_B+V_N)(-\Delta P_S)$$

$$\therefore V_1=V_S=-V_{B2}=-2\kappa C(V_B+V_N)\Delta P_S \quad \text{(Equation 4)}$$

Here, $V_{B1}$ represents the first voltage, $V_{B2}$ represents the second voltage, k represents the sensitivity constant, $C_0$ represents the initial capacitance, $V_B$ represents the bias, $\Delta P_S$ represents the sound pressure, $V_N$ represents the noise, $V_S$ represents the voltage change amount depending on the sound pressure change amount, and $V_1$ represents the first capacitance signal.

The detecting circuit 130 calculates the first voltage $V_{B1}$ output from the upper fixed film 11 of the sound detecting module 110' and the second voltage $V_{B2}$ output from the lower fixed film 13 through Equation 4.

Also, the detecting circuit 130 calculates the voltage change amount Vs by the difference of the first voltage $V_{B1}$ and the second voltage $V_{B2}$, thereby deducting the first capacitance signal $V_1$ changed depending on the sound pressure.

In this case, the noise may be included in first capacitance signal $V_1$ as confirmed in [Equation 4].

FIG. 10 is a view showing a signal processing structure in a second switch mode according to the second exemplary embodiment of the present invention.

Referring to FIG. 10, the switch controller 140 controls the switches by the second switch mode such that the signal processing structure that the second switch S2 and the fourth switch S4 are turned on, and the first switch S1 and the third switch S3 are turned off is shown.

The power source circuit 120 applies the second bias $-V_B$ that is opposed to the first bias $V_B$ to the sound detecting module 110 by the turn on of the second switch S2.

The detecting circuit 130 outputs the second capacitance signal $V_2$ varied based on the voltages $V_{B1}$ and $V_{B2}$ that are respectively output from the dual fixed films of the sound detecting module 110' depending on the sound pressure change amount.

In this case, the second capacitance signal $V_2$ may be calculated through [Equation 5] below.

$$\therefore V_2=V_S=-2\kappa C(-V_B+V_N)\Delta P_S. \quad \text{(Equation 5)}$$

Here, $V_2$ represents the second capacitance signal, $V_S$ represents the voltage change amount, k represents the sensitivity constant, $C_0$ means the initial capacitance, $V_B$ represents the bias, $V_N$ represents the noise, and $\Delta P_S$ represents the sound pressure.

The noise may be included in the first capacitance signal $V_2$ as confirmed in [Equation 5].

On the other hand, the detecting circuit 130 removes the noise included in the first capacitance signal $V_1$ and the second capacitance signal $V_2$ input from the input terminal of the calculating amplifier 132 and outputs the final output signal $V_O$ that the noise is removed and each capacitance signal is amplified to the output terminal.

The output signal $V_O$ may be determined by [Equation 6] below as the value that the second capacitance signal $V_2$ is subtracted from the first capacitance signal $V_1$.

$$V_0=V_1-V_2=-2\kappa C(V_B+V_N)\Delta P_S+2\kappa C(V_B+V_N)\Delta P_S$$

$$\therefore V_0=-4\kappa C V_B \Delta P_S$$

Here, $V_0$ represents the output signal, $V_1$ represents the first capacitance signal, $V_2$ represents the second capacitance signal, k represents s the initial sensitivity constant, $C_0$ represents the initial capacitance, $V_B$ represents the bias, and $\Delta P_S$ represents the sound pressure.

In this case, in the second exemplary embodiment of the present invention, since the single sound detecting module 100' is used, the output signal $V_O$ of which the noise $V_N$ is removed regardless of the process error like Equation 6 and the sensitivity which is four times may be output.

As described above, according to various embodiments of the present invention, the output signal by the sound pressure increases by at least twice through the dual fixed film MEMS structure and the signal processing structure removing the noise generated in the back bias such that the high sensitivity microphone improving the signal-to-noise ratio may be provided.

Also, by applying the sound detecting module of the single MEMS structure to the high sensitivity microphone, the process error in the conventional microphone applied with the plurality of MEMS may be solved.

Also, by applying the high sensitivity microphone of which the noise is removed and the sensitivity is improved to the vehicle, the sound recognition and the hands free performance in the vehicle may be improved such that an effect improving the customer satisfaction may be expected.

The above-described embodiments can be realized through a program for realizing functions corresponding to the configuration of the embodiments or a recording medium for recording the program in addition to through the above-described device and/or method.

For convenience in explanation and accurate definition in the appended claims, the terms "upper" or "lower", "inner" or "outer" and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A high sensitivity microphone comprising:

a sound detecting module including a vibration film and a fixed film separated from the vibration film;

a power source circuit supplying a power source, supplied from an outside, to the sound detecting module through a switch control of a first switch applying a first bias and a second switch applying a second bias that is opposed to the first bias;

a detecting circuit removing a noise included in a first capacitance signal and a second capacitance signal that are differential input from the sound detecting module, according to a switch control of a third switch inputting the first capacitance signal in conjunction with the first switch and a fourth switch inputting the second capacitance signal in conjunction with the second switch; and a switch controller performing a first switch mode linking the first switch and the third switch and a second switch mode linking the second switch and the fourth switch for a differential input and output of the microphone.

2. The high sensitivity microphone of claim 1, wherein the power source circuit turns on the first switch according to the first switch mode control and turns off the second switch to apply the first bias to the sound detecting module, and turns off the first switch according to the second switch mode control and turns on the second switch to apply the second bias to the sound detecting module.

3. The high sensitivity microphone of claim 1, wherein the detecting circuit includes a sample and hold circuit maintaining a voltage change amount depending on a sound pressure change amount transmitted from the sound detecting module; and a calculating amplifier removing a noise and amplifying the first capacitance signal and second capacitance signal to be output as a final output voltage when the first capacitance signal and the second capacitance signal depending on the voltage change amount are input.

4. The high sensitivity microphone of claim 3, wherein the sample and hold circuit maintains a voltage of the corresponding capacitance signal by memorizing the input voltage change amount even when one of the third switch and the fourth switch of the detecting circuit is turned off by a switching of the switch mode.

5. The high sensitivity microphone of claim 3, wherein the calculating amplifier removes the noise of the first capacitance signal and the second capacitance signal respectively input to a plurality of input terminals and outputs a final output signal of which each capacitance signal removed with the noise is amplified to the output terminal.

6. The high sensitivity microphone of claim 1, wherein the detecting circuit determines a final output as a value that the second capacitance signal is subtracted from the first capacitance signal.

7. The high sensitivity microphone of claim 1, wherein the first capacitance signal in the first switch mode and the second capacitance signal in the second switch mode are generated with a same sensitivity and capacitance change amount detecting condition.

8. A high sensitivity microphone comprising:

a sound detecting module including dual vibration films and a fixed film between the dual vibration films;

a power source circuit supplying a power source supplied from an outside to the sound detecting module through a switch control of a first switch applying a first bias and a second switch applying a second bias that is opposed to the first bias;

a detecting circuit removing a noise included in a first capacitance signal and a second capacitance signal that are differential input from the sound detecting module, according to a switch control of a third switch inputting the first capacitance signal in conjunction with the first switch and a fourth switch inputting the second capacitance signal in conjunction with the second switch; and a switch controller performing a first switch mode linking the first switch and the third switch, and a second switch mode linking the second switch and the fourth switch for a differential input and output of the microphone.

9. The high sensitivity microphone of claim 8, wherein the detecting circuit outputs the first capacitance signal varied based on the voltage respectively output from the dual fixed film according to a sound pressure change amount of the sound detecting module when the first bias is applied to the sound detecting module by the turning on of the first switch of the power source circuit.

10. The high sensitivity microphone of claim 9, wherein the detecting circuit outputs the second capacitance signal varied based on the voltage respectively output from the dual fixed films according to the sound pressure change amount of the sound detecting module when the second bias opposed to the first bias is applied to the sound detecting module by the turning on of the second switch of the power source circuit.

11. The high sensitivity microphone of claim 8, wherein the detecting circuit includes:

a third switch inputting the first capacitance signal to the calculating amplifier in conjunction with the first switch of the power source circuit during the first switch mode; and a fourth switch inputting the second capacitance signal to the calculation amplifier in conjunction with the second switch of the power source circuit during the second switch mode.

12. The high sensitivity microphone of claim 11, wherein the detecting circuit includes a sample and hold circuit memorizing the voltage change amount transmitted from the sound detecting module and maintaining a voltage of the corresponding capacitance signal even when one of the third switch and the fourth switch of the detecting circuit is turned off by a switching of the switch mode.

13. The high sensitivity microphone of claim 12, wherein the detecting circuit includes a calculating amplifier removing the noise included in the first capacitance signal and the second capacitance signal input to a plurality of input terminals from the sample and hold circuit and outputting a final output signal that each capacitance signal removed with the noise is amplified to the output terminal.

* * * * *